US010074910B1

(12) United States Patent
Buckley et al.

(10) Patent No.: US 10,074,910 B1
(45) Date of Patent: Sep. 11, 2018

(54) SWITCHABLE X BAND COMMUNICATION PANEL

(71) Applicant: Rockwell Collins, Inc., Cedar Rapids, IA (US)

(72) Inventors: Michael J. Buckley, Marion, IA (US); Jeremiah D. Wolf, Marion, IA (US); Matilda G. Livadaru, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 367 days.

(21) Appl. No.: 14/449,799

(22) Filed: Aug. 1, 2014

(51) Int. Cl.
*H01Q 21/22* (2006.01)
*H01Q 21/06* (2006.01)
*H01Q 1/38* (2006.01)

(52) U.S. Cl.
CPC ..... *H01Q 21/22* (2013.01); *H01Q 1/38* (2013.01); *H01Q 21/061* (2013.01)

(58) Field of Classification Search
CPC ..... H01Q 21/20; H01Q 21/205; H01Q 21/22
See application file for complete search history.

(56) References Cited

U.S. PATENT DOCUMENTS

| | | | | |
|---|---|---|---|---|
| 4,010,474 | A * | 3/1977 | Provencher | H01P 1/19 333/24.1 |
| 4,899,162 | A * | 2/1990 | Bayetto | H01Q 21/205 343/700 MS |
| 6,188,373 | B1 * | 2/2001 | Martek | H01Q 1/246 342/375 |
| 6,650,291 | B1 * | 11/2003 | West | H01Q 3/46 342/371 |
| 9,391,375 | B1 * | 7/2016 | Bales | H01Q 21/24 |
| 2004/0174303 | A1 * | 9/2004 | Duxbury | H01Q 1/246 343/700 MS |
| 2007/0257858 | A1 * | 11/2007 | Liu | H01Q 1/007 343/893 |
| 2010/0079347 | A1 * | 4/2010 | Hayes | H01Q 1/246 343/705 |
| 2012/0306698 | A1 * | 12/2012 | Warnick | H01Q 5/35 342/372 |

* cited by examiner

*Primary Examiner* — Daniel J Munoz
(74) *Attorney, Agent, or Firm* — Angel N. Gerdzhikov; Donna P. Suchy; Daniel M. Barbieri

(57) ABSTRACT

A fixed antenna includes multiple printed board panels, each containing an array of radiating elements where a subset of radiating elements receives a delayed signal from a feed layer. The number of panels is minimized by configuring each array to generate a shaped beam. The shaped beam is produced by non-uniformly spaced elements and non-uniform array element phase shifts.

13 Claims, 6 Drawing Sheets

SWITCHABLE X BAND COMMUNICATION PANEL

FIELD OF THE INVENTION

The present invention is directed generally toward array antennas, and more particularly, but not by way of limitation, toward segmented circular planar array antennas.

BACKGROUND

Directional networking requires high throughput and therefore higher directional gain antennas. Existing technology utilizes parasitic arrays to provide cheap implementation of communication directionality but lacks the necessary gain and thus communication range. Alternatively, some existing technology utilizes mechanical arrays. Mechanical arrays add significant cost and complexity.

Consequently, it would be advantageous if an apparatus existed that had increased antenna gain compared to a parasitic array without the cost and complexity of a mechanical array.

SUMMARY

Accordingly, embodiments of the present invention are directed to a novel method and apparatus that has relatively high gain without the cost and complexity of a mechanical array. The apparatus uses low cost, high dielectric constant FR-4 printed circuit board materials.

In at least one embodiment, a fixed antenna includes multiple FR-4 printed board panels, each including an array of radiating elements where a subset of radiating elements receives a time delayed signal from a feed layer. The number of panels is minimized by configuring each array to generate a shaped beam. The shaped beam is produced by non-uniformly spaced elements and non-uniform array element phase shifts.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles.

BRIEF DESCRIPTION OF THE DRAWINGS

The numerous advantages of the present invention may be better understood by those skilled in the art by reference to the accompanying figures in which.

DETAILED DESCRIPTION

Reference will now be made in detail to the subject matter disclosed, which is illustrated in the accompanying drawings. The scope of the invention is limited only by the claims; numerous alternatives, modifications and equivalents are encompassed. For the purpose of clarity, technical material that is known in the technical fields related to the embodiments has not been described in detail to avoid unnecessarily obscuring the description.

Figure 1:
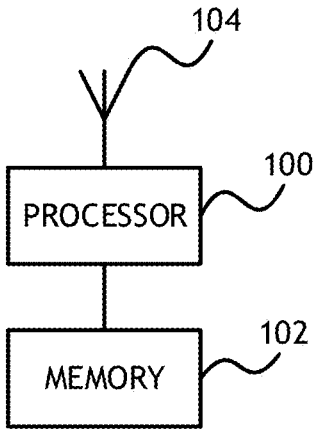
FIG. 1 shows a block diagram of a communication system utilizing embodiments of the present invention.

Referring to FIG. 1, a communication system according to embodiments of the present invention includes a process 100, memory 102 connected to the processor 100 for storing computer executable program code, and an antenna 104 comprising panels of radiating elements. The panels of radiating elements may be configured to allow directional transmission over substantially the entire horizon.

The processor 100 may apply variable signals to radiating elements in the antenna 104 to vary to directionality of a corresponding signal over time. Embodiments of the inventive concepts disclosed herein may be stationary transmission points or incorporated into mobile platforms such as aircraft or ground vehicles.

Figure 2:
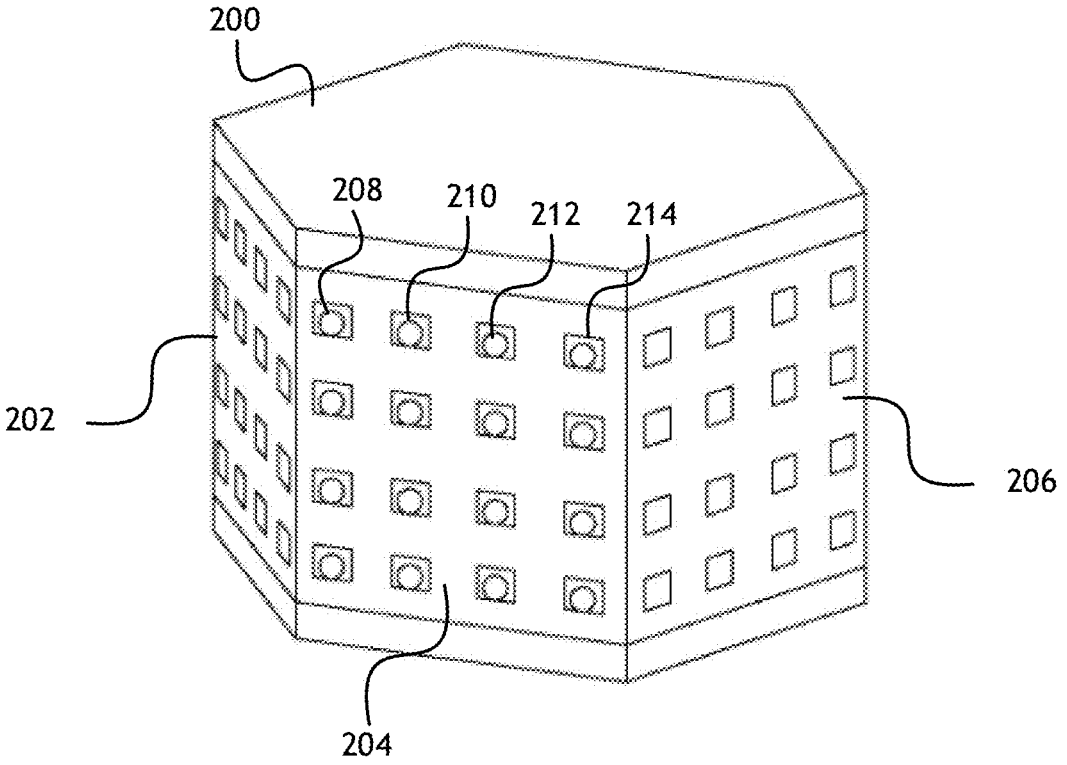
FIG. 2 shows a perspective view of a segmented FR-4 printed circuit board circular planar array antenna according to an embodiment of the present invention.

Referring to FIG. 2, an embodiment of an antenna 200 according to an embodiment of the present invention includes a plurality of FR-4 printed circuit board panels 202, 204, 206. Each of the plurality of panels 202, 204, 206 has a plurality of radiating elements 208, 210, 212, 214 configured to produce a shaped beam radiating pattern. The plurality of panels 202, 204, 206 may be organized to provide complete, 360° of transmission coverage. Further, the radiating elements 208, 210, 212, 214 may be organized to produce a shaped beam covering a portion of the horizon defined by the number of panels 202, 204, 206 in the antenna 200. In some embodiments, the entire horizon may be covered by six panels 202, 204, 206 as compared to fourteen panels of prior art implementations. The directional radiating pattern may enhance transmission security by lowering the probability of signal interception.

Figure 3:
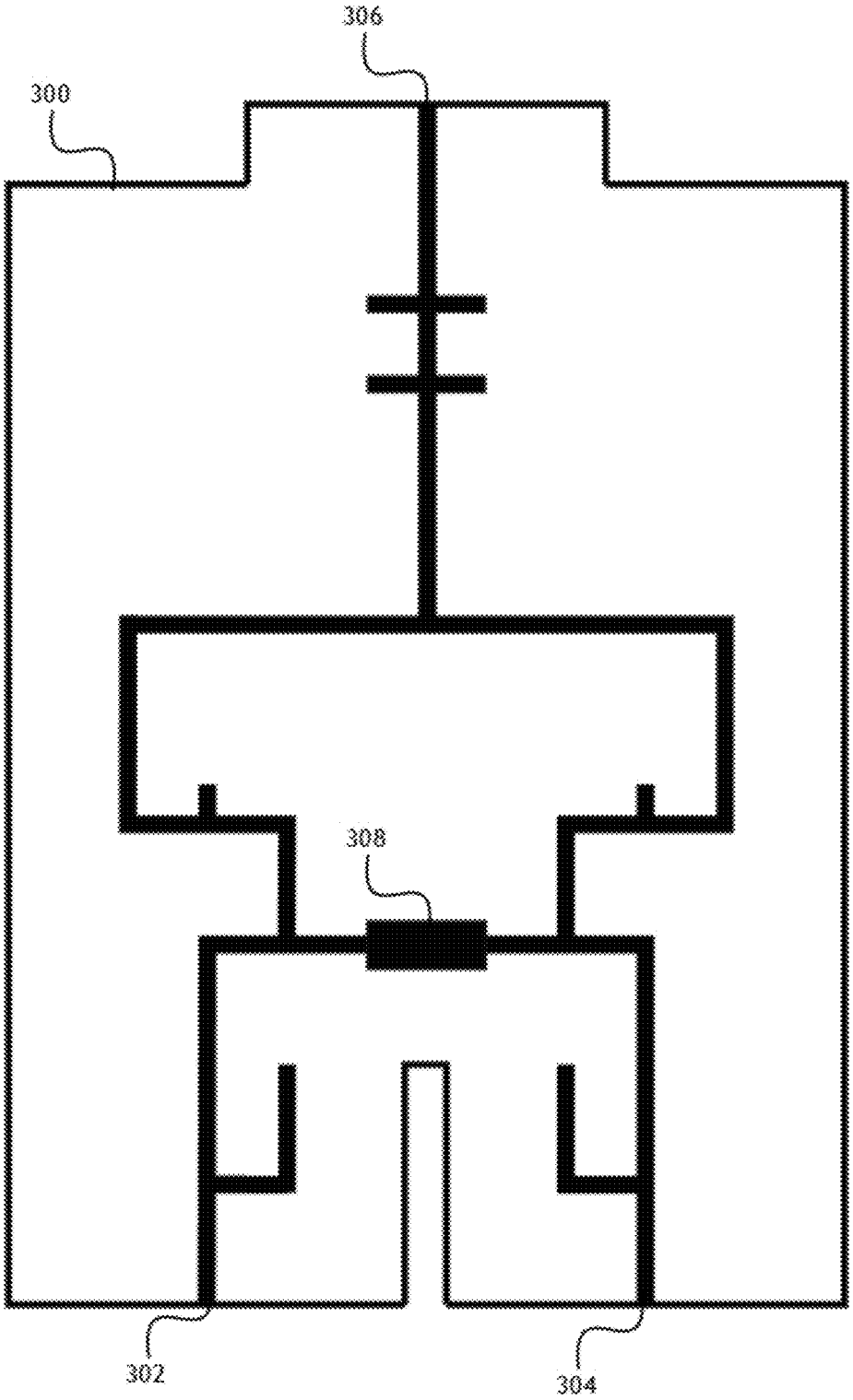
FIG. 3 shows a block diagram of a Wilkinson power divider element according to at least one embodiment of the present invention.

Referring to FIG. 3, a Wilkinson power divider element 300 according to embodiments of the present invention may include an input port 306 to a conductive circuit, a first output port 302 and a second output port 304. The first output port 302 and second output port 304 are isolated from each other by a resistance element 308. In some embodiments, the resistance element 308 includes a resistive film suitable for printing on a circuit board.

Figure 4:
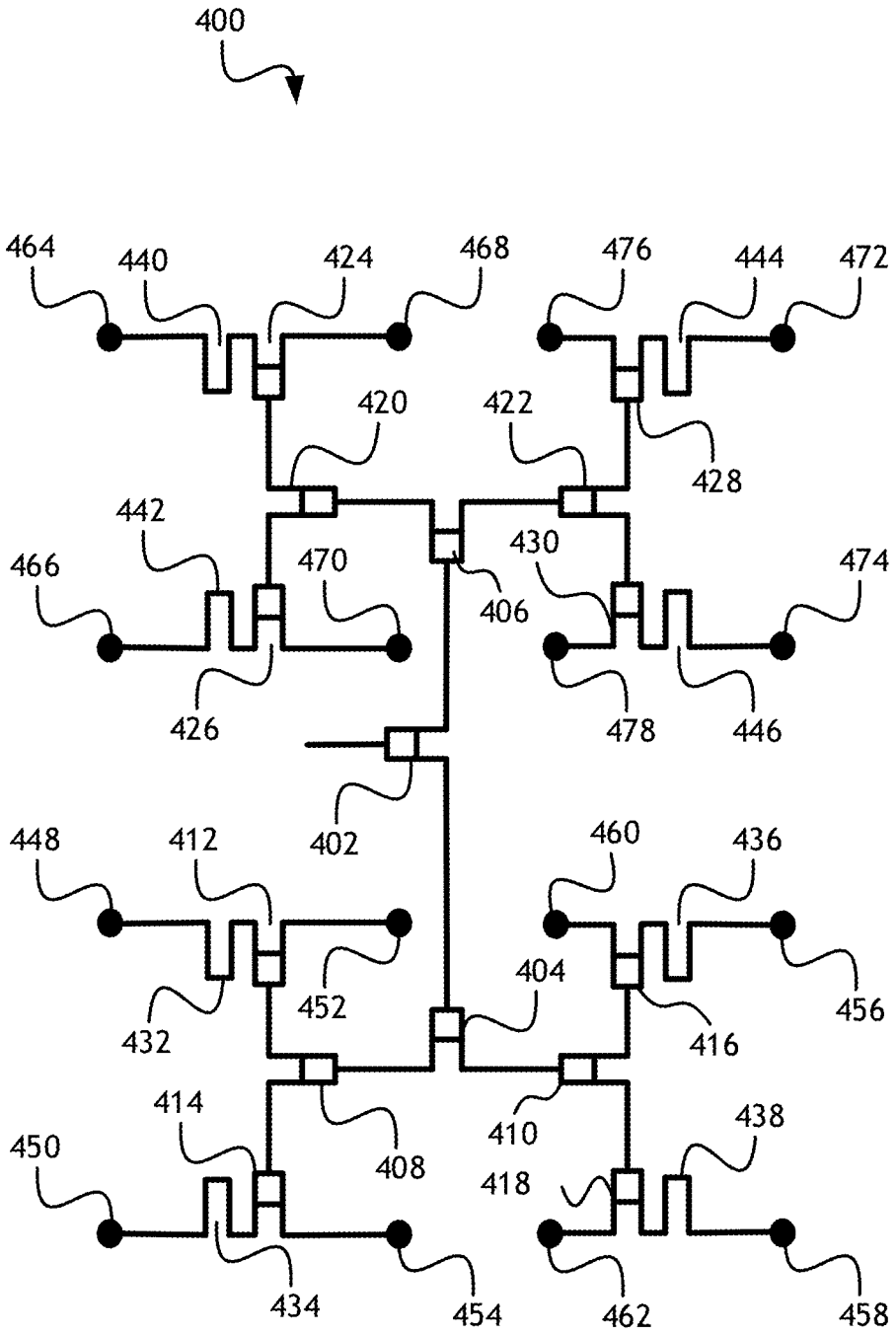
FIG. 4 shows a representation of a stripline feed layer of an antenna panel according to an embodiment of the present invention.

Referring to FIG. 4, a stripline feed layer 400 of an antenna panel according to an embodiment of the present invention includes a system of Wilkinson power dividers 402, 404, 406, 408, 410, 412, 414, 416, 418, 420, 422, 424, 426, 428, 430 to feed power to a plurality of metallization layer elements through metallization connecting probes 448, 450, 452, 454, 456, 458, 460, 462, 464, 466, 468, 470, 472, 474.

In some embodiments, the power dividers are arranged such that a primary power divider 402 receives an input and sends power to two secondary power dividers 404, 406. Each of the secondary power dividers 404, 406 sends power to two tertiary power dividers 408, 410, 420, 422. Each of the tertiary power dividers 408, 410, 420, 422 sends power to two quaternary power dividers 412, 414, 416, 418, 424, 426, 428, 430. A person skilled in the art having the benefit of the instant disclosure will appreciate that the number and organization of power dividers 402, 404, 406, 408, 410, 412, 414, 416, 418, 420, 422, 424, 426, 428, 430 is exemplary, and different numbers and organizations are contemplated within the scope of the inventive concepts disclosed herein.

In some embodiments, radiation patterns from individual elements in the metallization layer are combined to produce a shaped beam radiation pattern. For example, metallization elements may be connected to a connecting probe 448, 450, 452, 454, 456, 458, 460, 462, 464, 466, 468, 470, 472, 474, 476, and 487 to produce a shaped beam radiation pattern.

The connecting probes 448, 450, 452, 454, 456, 458, 460, 462, 464, 466, 468, 470, 472, 474, 476, and 487 are non-uniformly spaced and have non-uniform phase shifts 432, 434, 436, 438, 440, 442, 444, 446 in order to produce a shaped beam radiation pattern.

Figure 5:
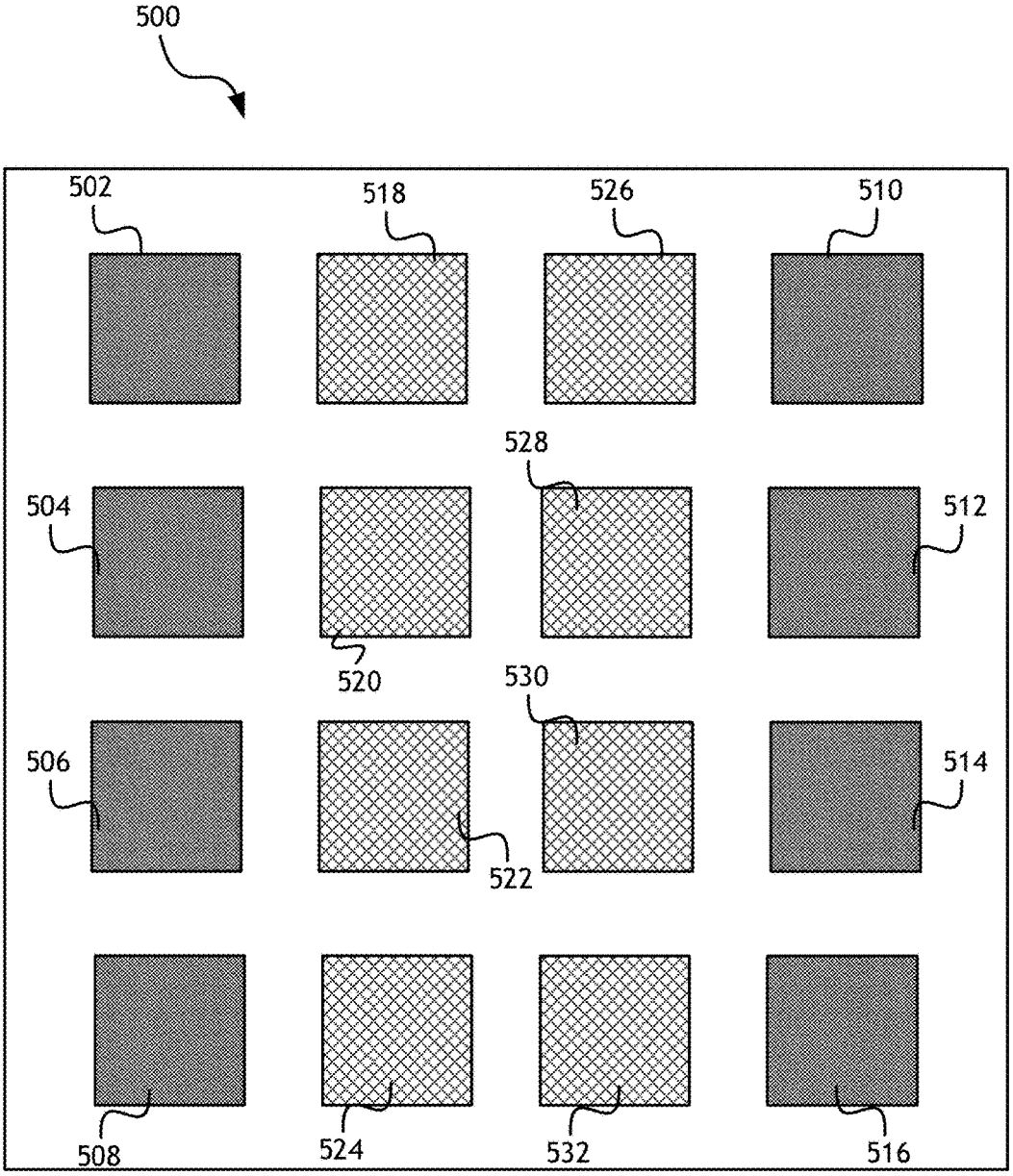
FIG. 5 shows a block diagram representation of a metallization layer of an antenna panel according to an embodiment of the present invention.

Referring to FIG. 5, a metallization layer of an antenna panel 500 according to an embodiment of the present invention is shown. An FR-4 printed circuit board antenna panel 500 according to at least one embodiment of the present invention may include radiating elements 502, 504, 506, 508, 510, 512, 514, 516, 518, 520, 522, 524, 526, 528, 530, 532. An integrated stripline feed manifold distributes power to the individual radiating elements.

While exemplary embodiments described herein illustrate a panel 500 having a four-by-four array of radiating elements 502, 504, 506, 508, 510, 512, 514, 516, 518, 520, 522, 524, 526, 528, 530, 532, a person skilled in the art may appreciate that different configurations of radiating elements 502, 504, 506, 508, 510, 512, 514, 516, 518, 520, 522, 524, 526, 528, 530, 532 are envisioned. Any N-by-M array of radiating elements utilizing different metallization configurations and signal delays may be utilized. A larger number of array elements may produce superior gain.

The exemplary embodiments defined herein are specifically directed toward an array wherein the center two columns of radiating elements 518, 520, 522, 524, 526, 528, 530, 532 are substantially similar while the outer two columns of radiating elements 502, 504, 506, 508, 510, 512, 514, 516 are substantially similar and differentiated from the center two columns. Further, the outer two columns of radiating elements 502, 504, 506, 508, 510, 512, 514, 516 are fed a delayed signal from the feed layer.

A shaped beam antenna for switched beam transmission according to the inventive concepts disclosed herein may be configured for long range, high data rate communication through the combination of amplifiers and X-band antenna panel 500. Some embodiments may allow for data communication up to 140 km.

Figure 6:
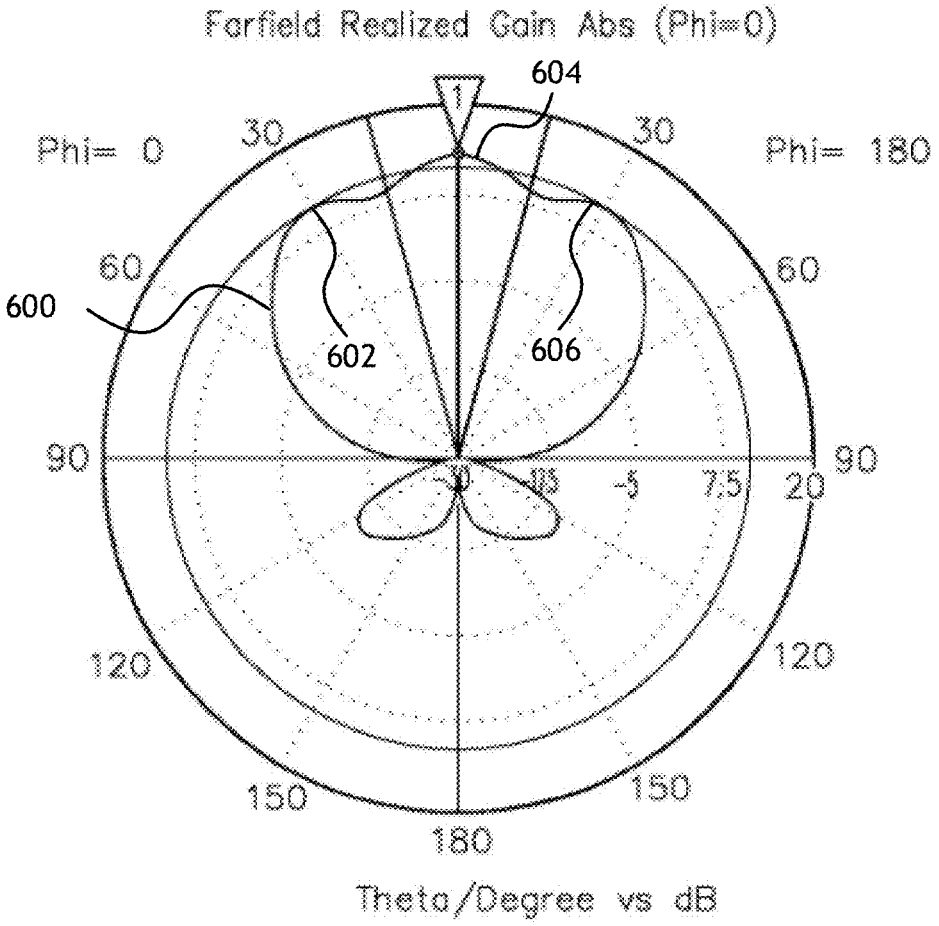
FIG. 6 shows a graphical representation of a radiation pattern produced by an embodiment of the present invention.

Referring to FIG. 6, a radiation pattern produced by an embodiment of the present invention is shown. A single FR-4 printed circuit board radiating panel may be configured to produce a radiation pattern 600 with relatively high gain along a 60° arc centered on a line orthogonal to the printed circuit board panel. Signals from various radiating elements may interact through constructive and destructive interference to produce the shaped beam pattern. An antenna including six panels according to the inventive concepts disclosed herein, where each panel is offset by 60° as compared to the neighboring panels, may allow for substantially directional transmission in an y direction along a horizon. Further, signals produced by adjacent panels may interact via constructive and destructive interference to further enhance or degrade a signal in a particular direction. A person skilled in the art having the benefit of the instant disclosure may appreciate that signals applied to adjacent panels may control final signal directionality within tolerances defined by the characteristics of the panels, power dividers and desired signal gain.

Figure 7:
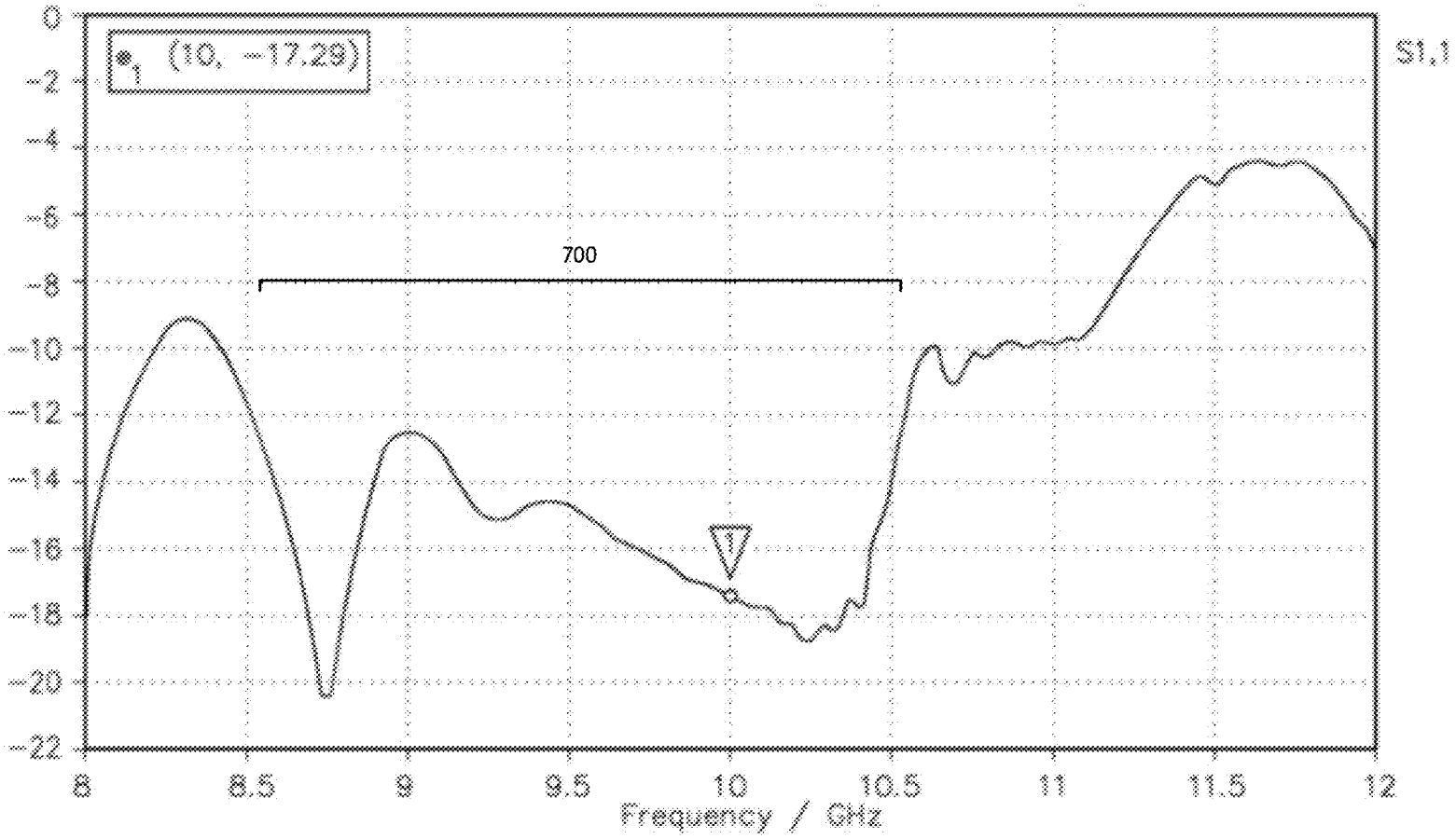
FIG. 7 shows a graphical representation of the calculated return loss of a 4×4 array panel, including the stripline manifold

Referring to FIG. 7, a calculated return loss of a 4×4 array panel, including the stripline manifold is shown. An array panel according to some embodiments of the present invention may produce return loss below −10 dB over a frequency range 700 of approximately 8.5 to 10.5 GHz with an operational frequency range of 9.5 to 10.5 GHz.

It is believed that the present invention and many of its attendant advantages will be understood by the foregoing description of embodiments of the present invention, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An antenna comprising:

a plurality of six printed circuit board panels arranged in a hexagonal configuration, each of the printed circuit board panels comprising:

a metallization layer comprising a first category of radiating elements comprising two outside columns and a second category of radiating elements comprising two center columns wherein the second category is distinct from the first category; and a feed layer comprising a plurality of Wilkinson power dividers, each Wilkinson power divider comprising two connecting probes separated by resistive film, the feed layer configured to supply a signal to each of the radiating elements in the metallization layer via a connecting probe associated with each radiating element, the connecting probes being non-uniformly spaced with relation to a corresponding radiating element, each radiating element in the first category of radiating elements corresponding to a connecting probe associated with a dedicated non-uniform phase shift element such that the signal supplied to the first category of radiating elements is time delayed with respect to the signal supplied to the second category of radiating elements, wherein:

each printed circuit board panel and corresponding feed layer is configured to produce radiation pattern having high gain along a 60° arc centered on a line orthogonal to the printed circuit board panel; and each of a set of Wilkinson power dividers in the plurality of Wilkinson power dividers configured to supply a single radiating element in the first category of radiating elements and a single radiating element in the second category of radiating elements.

2. The antenna of claim 1, wherein:

Each metallization layer comprises a four-by-four array of radiating elements;

The first category of radiating elements comprises outside columns of radiating elements in the four-by-four array; and The second category of radiating elements comprises center columns of radiating elements in the four-by-four array.

3. The antenna of claim 2, wherein each printed circuit board panel comprises a low cost high dielectric constant FR-4 material.

4. A communication system comprising:

an antenna having an operational frequency range of 9.5 GHz to 10.5 GHz and return loss below −10 dB over a frequency range of 8.5 GHz to 10.5 GHz, the antenna comprising:

a plurality of printed circuit board panels, each of the printed circuit board panels comprising:

a metallization layer comprising a first category of radiating elements having a first configuration, comprising two outside columns, and a second category of radiating elements having a second configuration distinct from the configuration of the first category of radiating element with relation to a location of a connecting probe in the radiating elements, comprising two center columns; and a feed layer comprising a plurality of Wilkinson power dividers, each Wilkinson power divider comprising two connecting probes separated by resistive film, the feed layer configured to supply a signal to each of the second category of radiating elements and a delayed signal to each of the first category of radiating elements, each radiating element in the first category of radiating elements corresponding to a connecting probe associated with a dedicated non-uniform phase shift element such that the signal supplied to the first category of radiating elements is time delayed with respect to the signal supplied to the second category of radiating elements, wherein:

each printed circuit board panel and corresponding feed layer is configured to produce radiation pattern having high gain along a 60° arc centered on a line orthogonal to the printed circuit board panel; and each of a set of Wilkinson power dividers in the plurality of Wilkinson power dividers configured to supply a single radiating element in the first category of radiating elements and a single radiating element in the second category of radiating elements.

5. The communication system of claim 4, wherein:

the metallization layer comprises a four-by-four array of radiating elements;

the first category of radiating elements comprises outside columns of radiating elements in the four-by-four array; and the second category of radiating elements comprises center columns of radiating elements in the four-by-four array.

6. The communication system of claim 4, wherein the plurality of printed circuit board panels comprises six printed circuit board panels arranged in a hexagonal configuration.

7. The communication system of claim 4, wherein each printed circuit board panel comprises a low cost high dielectric constant FR-4 material.

8. The communication system of claim 4, further comprising a processor connected to the antenna, the processor configured to apply signals to the feed layer to produce radiation patterns of variable directionality over time.

9. A mobile platform comprising:

communication system having an antenna comprising:

a plurality of printed circuit board panels, each of the printed circuit board panels comprising:

a metallization layer comprising:

a first category of radiating elements having a first configuration, comprising two outside columns;

a second category of radiating elements having a second configuration distinct from the configuration of the first category of radiating element, comprising two center columns; and an integrated stripline feed manifold configured to distribute power to the radiating elements from a feed layer; and a feed layer comprising a plurality of Wilkinson power dividers, each Wilkinson power divider comprising two connecting probes separated by resistive film, the feed layer configured to supply a signal to each of the second category of radiating elements and a delayed signal to each of the first category of radiating elements via a connecting probe associated with each radiating element, each radiating element in the first category of radiating elements corresponding to a connecting probe associated with a dedicated non-uniform phase shift element, wherein:

each printed circuit board panel and corresponding feed layer is configured to produce radiation pattern having high gain along a 60° arc centered on a line orthogonal to the printed circuit board panel; and each of a set of Wilkinson power dividers in the plurality of Wilkinson power dividers configured to supply a single radiating element in the first category of radiating elements and a single radiating element in the second category of radiating elements.

10. The mobile platform of claim 9, wherein the plurality of printed circuit board panels comprises six printed circuit board panels arranged in a hexagonal configuration.

11. The mobile platform of claim 10, wherein:

each metallization layer comprises a four-by-four array of radiating elements;

the first category of radiating elements comprises outside columns of radiating elements in the four-by-four array; and the second category of radiating elements comprises center columns of radiating elements in the four-by-four array.

12. The mobile platform of claim 11, wherein each printed circuit board panel comprises a low cost high dielectric constant FR-4 material.

13. The mobile platform of claim 9, wherein the communication system further comprises a processor connected to the antenna, the processor configured to apply signals to the feed layer to produce radiation patterns of variable directionality over time.

* * * * *